US005406645A

United States Patent [19]

Lin

[11] Patent Number: 5,406,645

[45] Date of Patent: Apr. 18, 1995

[54] SUNSHADE CAP WITH A DOUBLE LAYER VISOR

[76] Inventor: Ming-Huei Lin, No. 697, Sec. 1, Chung Shan Rd. Hu-Nei Hsiang Kaohsiung Hsiung, Taiwan, Prov. of China

[21] Appl. No.: 86,646

[22] Filed: Jul. 2, 1993

Related U.S. Application Data

[63] Continuation of Ser. No. 970,466, Nov. 2, 1992, Pat. No. 5,271,099.

[51] Int. Cl.[6] ..... A42B 1/18

[52] U.S. Cl. ..... 2/10; 2/175.6; 2/209.13

[58] Field of Search ..... 2/7, 10, 11, 12, 15, 2/171, 171.1, 175.1, 175.2, 175.3, 175.6, 184.5, 195.1, 209.11, 209.12, 209.13

[56] References Cited

U.S. PATENT DOCUMENTS

| | | | |
|---|---|---|---|
| 65,871 | 6/1867 | Browne | 2/175.6 |
| 317,972 | 5/1885 | Cary | 2/175.6 |
| 1,587,681 | 6/1926 | Schumacher | 2/175.6 |
| 5,125,113 | 6/1992 | Yun | 2/10 |
| 5,157,788 | 10/1992 | Schultz | 2/7 |
| 5,214,801 | 6/1993 | Christensen et al. | 2/184.5 |
| 5,271,099 | 12/1993 | Lin | 2/10 |

*Primary Examiner*—Clifford D. Crowder
*Assistant Examiner*—Diana L. Biefeld

[57] ABSTRACT

A sunshade cap with a double layer visor as a continue-in-part comprising an upper layer visor shaped annular or consisted of a front, a left, and a right visor and constituted of a middle layer and an upper and a lower layer made of a reflective material, the upper layer visor having a central hole defined by the annular inner circumferential edge or the inner edges of the three visors to fit around a circumferential edge of a sunshade cap body with a visor, and a fastener band fastening with a fastener band on a visor of the sunshade cap body.

1 Claim, 5 Drawing Sheets

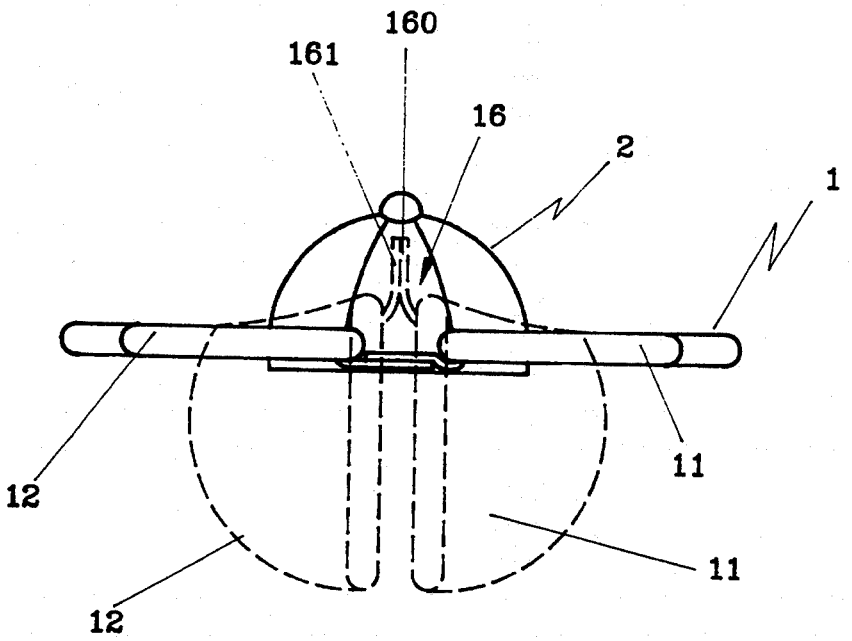
Fg 5
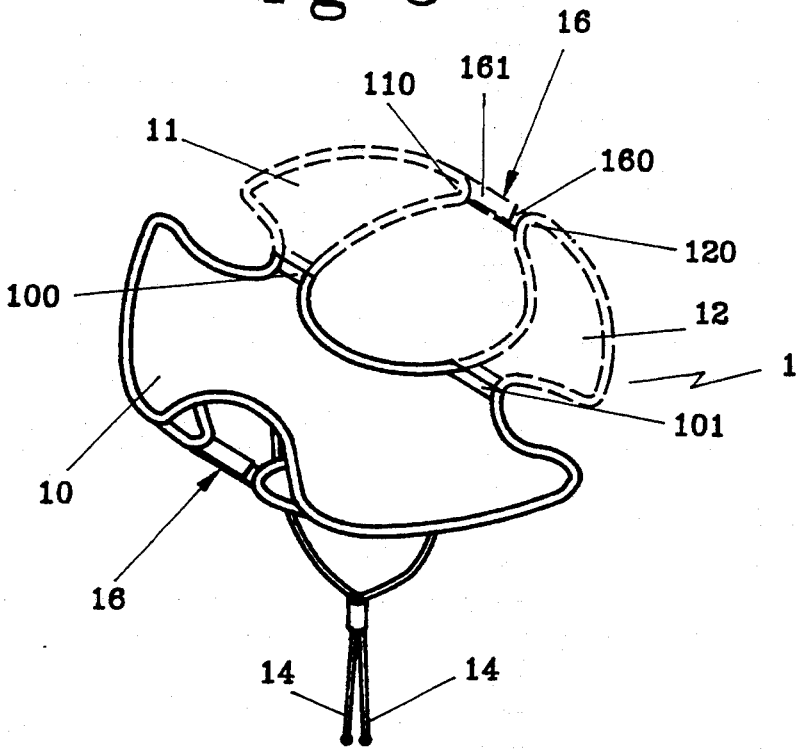
Fig 6

SUNSHADE CAP WITH A DOUBLE LAYER VISOR

This invention is a continuation of U.S. patent application Ser. No. 07/970,466, filed Nov. 2, 1992, now U.S. Pat. No. 5,271,099. Which is before long to be permitted.

BACKGROUND OF THE INVENTION

U.S. Pat. Nos. 65,871, 317,972, and 1,587,681 show hats with detachable sunshades.

U.S. Pat Nos. 5,125,113 and 5,214,801 show visors formed of sections which are pivotal with respect to each other.

U.S. Pat. No. 5,157,788 shows a hat with heat reflecting capabilities.

U.S. Pat. No. 5,271,099 shows a cap with a double layer visor.

SUMMARY OF THE INVENTION

This invention has ben devised to strengthen function of the upper layer visor removable from the cap body.

One feature of this invention is an upper layer visor made of an insulating material, foldable, very light for easy carrying and storing.

Another feature is a changeable shape of the upper layer visor and its dimension changeable as well.

Another feature is provision of an adjuster between a left and a right visor of the upper layer visor for altering the angle of both the visors in accordance to an angle of the sun.

Another feature is provision of a band attached to the upper layer visor to be tied under a user's chin for preventing the visor from being blown away by a strong wind.

One more feature is provision of a front visor, a left visor and a right visor of the upper layer visor formed as integrated.

BRIEF DESCRIPTION OF THE DRAWINGS

FIG. 5 is a rear view of the first embodiment of the sunshade cap with a double layers visor in the present invention.

FIG. 6 is a perspective view of the upper layer visor in the present invention, showing how the left and the right visor of the upper layer visor be folded down.

DETAILED DESCRIPTION OF THE INVENTION

Figure 1:
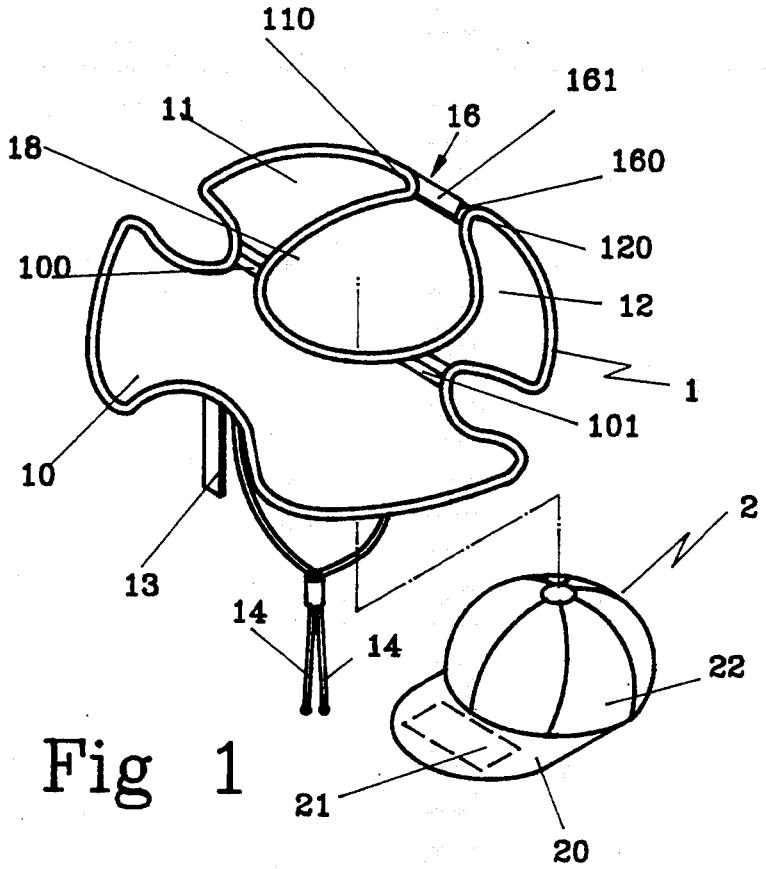
FIG. 1 is an exploded perspective view of a first embodiment of a sunshade cap with a double layer visor in the present invention.
Figure 2:
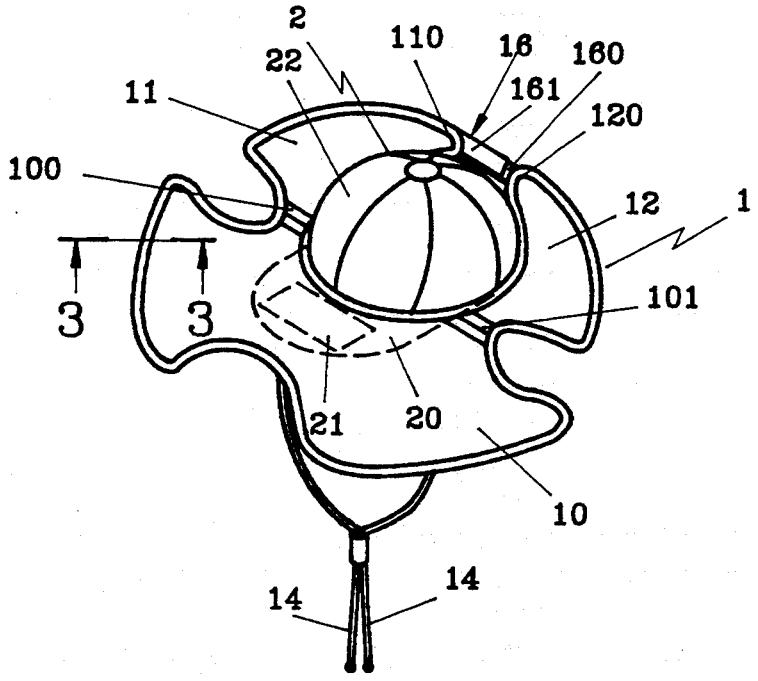
FIG. 2 is a perspective view of the first embodiment of the sunshade cap with a double layer visor in the present invention.
Figure 4:
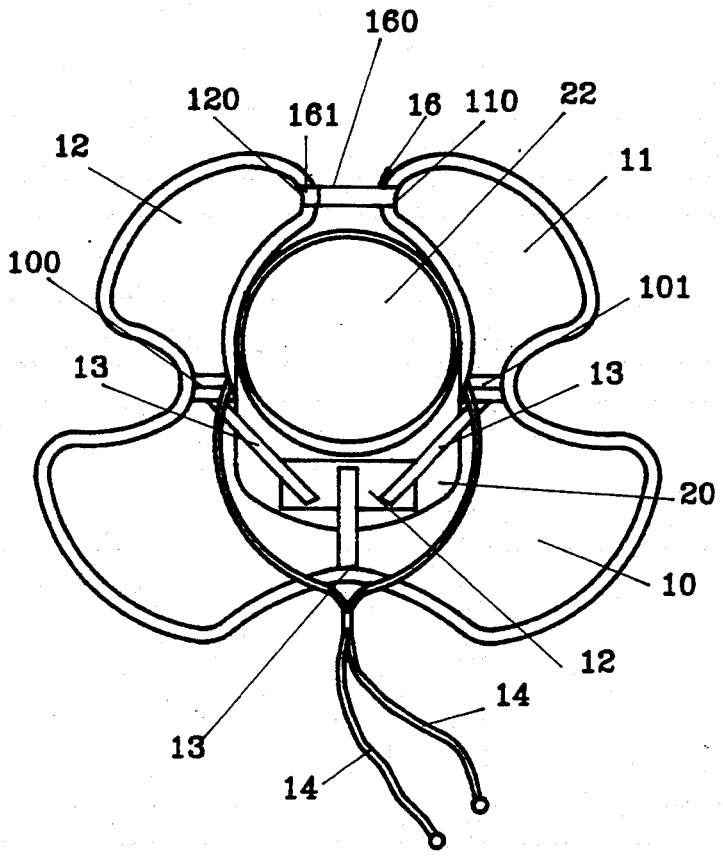
FIG. 4 is a bottom view of the first embodiment the sunshade cap with a double layer visor in the present invention.

The sunshade cap with a double layer visor in the present invention as a continuation of U.S. patent application Ser. No. 07/970,466, as shown in FIGS. 1 and 2, comprises an upper layer visor consisting of three visors, i.e. a front visor 10, a left visor 11 and a right visor 12 front visor 10 is connected to left visor 11 along a hinged connection 100. Additionaly, front visor 10 is connected to right visor 12 along hinged connection 101. The three visors 10, 11, 12 define a central opening 18 with their inner circumferential edges to fit around a sunshade cap body 22 so as to combine the upper layer visor 1 with the sunshade cap 2. Between the front one 10 and the left one 11 or the right one 12 is provided a guide connecting edge 100 or 101 and sewn together to become an upper layer visor, foldable as shown in FIG. 6. Assembling the upper layer visor 1 with the sunshade cap 2 is effected by three fastener bands 13, shown in FIG. 4. sewn under the bottom surface of the upper layer visor 1 so as to fasten with a fastener band 21 provided under a visor 20 of the sunshade cap 2.

The fastener bands 13 can be substituted by a male and a female fastener or an elastic band with a button, etc.

In order to keep the upper layer visor stable with the sunshade cap 2, a tie band 14 can be provided to be tied under a chin of a user, preventing it from blown off the cap 2 in case of a strong wind.

Provided that a combined angle between the left and the right visor 11, 12 is wanted to be adjusted, a size adjustment mechanism 16 is provided between them, consisting of an upper and a lower pieces 160, 161 respectively attached with a side edge 110, 120 of the left and the right visor 11, 12. The size adjustment mechanism 16 can be effected with a fastener band or a male and a female fastener instead of the pieces 160, 161. Then if the adjusting means 16 is adjusted in its position, the folding down angle of the left and the right visor 11, 12 can be altered as shown in FIG. 5. So user's ear's and neck can be shaded from slanting sunshine.

Figure 3:
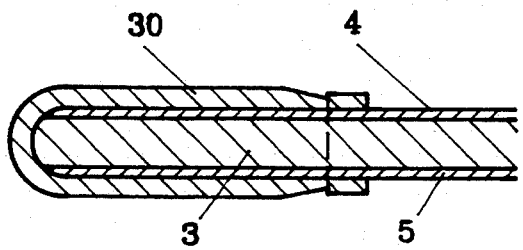
FIG. 3 is a cross-sectional view of line 3—3 in FIG. 2.
Figure 9:
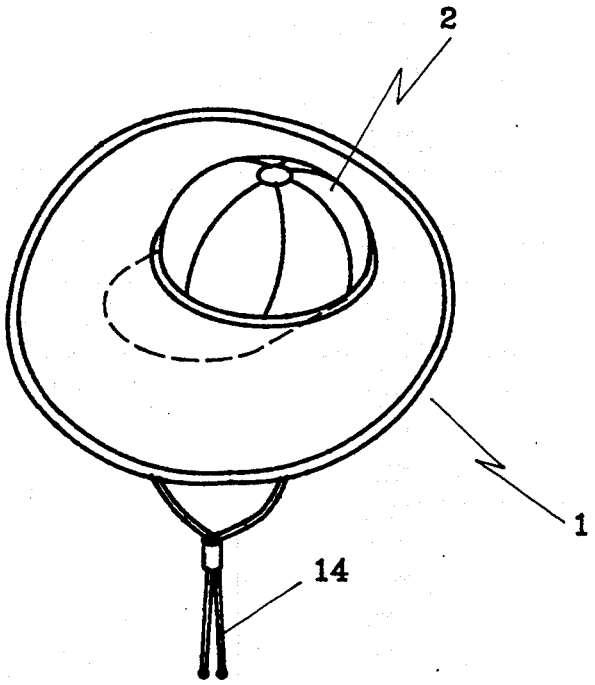
FIG. 9 is a perspective view of a fourth embodiment of the sunshade cap with a double layer visor in the present invention.
Figure 10:
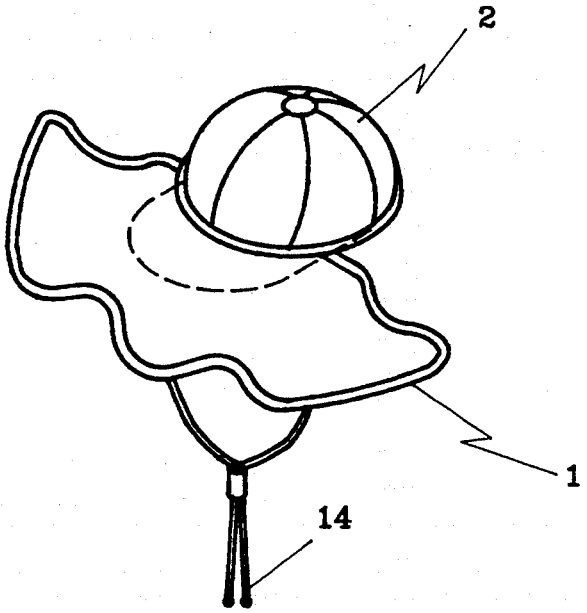
FIG. 10 is a perspective view of a fifth embodiment of the sunshade cap with a double layer visor in the present invention.

No matter whether the upper layer visor 1 is made annular shown in FIGS. 9, 10 or of three or more visors 10, 11, 12, they are made of a middle layer 3, and a reflective upper layer 4 and a reflective lower layer 5 are combined together with a sewn outer edge 30 as shown in FIG. 3, making it durable and beautiful. As to the material of the middle layer 3 can be plastic, paper or the like having a proper hardness and a light weight. The upper and the lower reflective layer can be made of aluminum foil without or with vacuum plating, permitting it reflex sunlight so that the upper visor may not easily absorb heat. As the upper layer visor 1 is very light, so it does not give any extra burden to the head of a user, able to shade sunshine and insulate heat very well.

Figure 7:
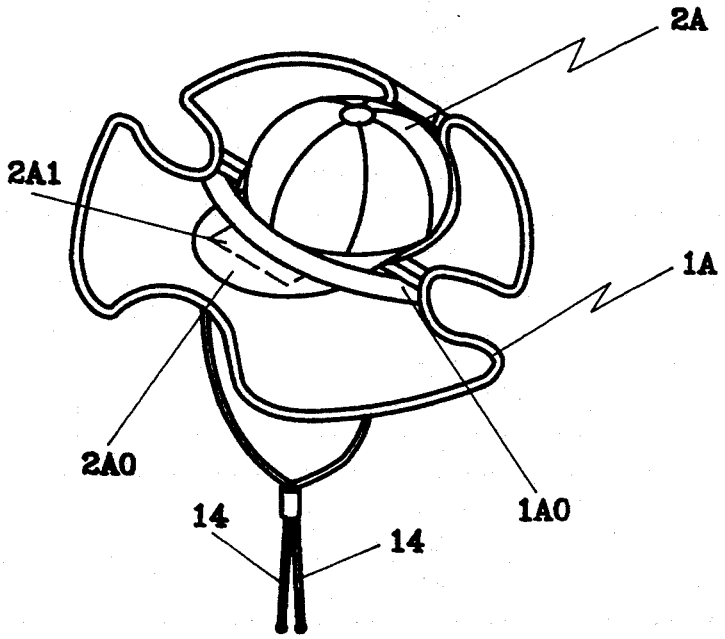
FIG. 7 is a perspective view of a second embodiment of the sunshade cap with a double layer visor in the present invention.

For various different methods of combining the sunshade cap and the upper layer visor 1, FIG. 7 shows one example, which has a fastener band 1A0 sewn on a upper layer visor 1A and a fastener band 2A 1 sewn on visor 2A0 of a sunshade cap 2A so that the two fastener bands 1A0. 2A0 can be fastened together, either with the fastener band 1A0 on or under the fastener band 2A0 for the same function.

Figure 8:
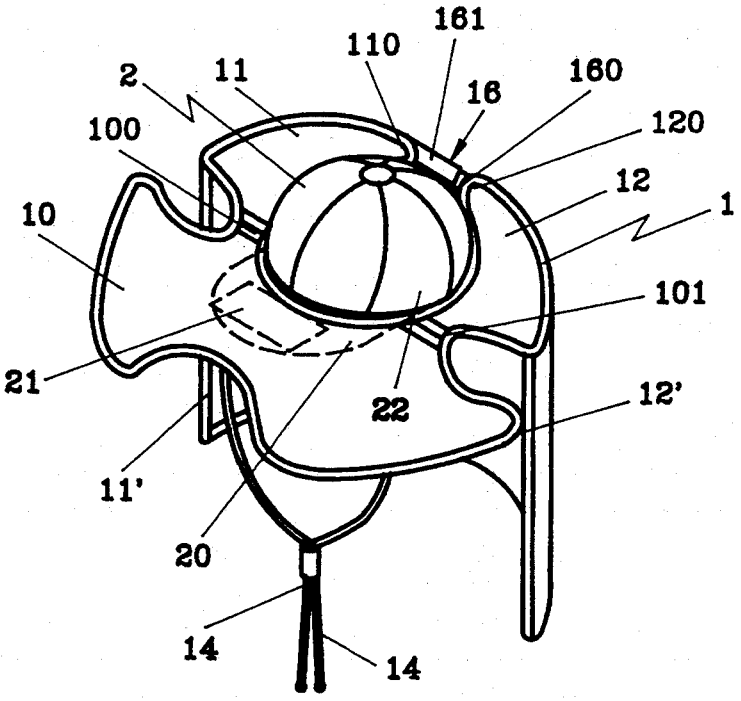
FIG. 8 is a perspective view of a third embodiment of the sunshade cap with a double layer visor in the present invention.

A third embodiment of the sunshade cap with a double layer visor is shown in FIG. 8, having two dangling down visor slips 11', 12' respectively extending down from the outer edge of the left and right visor 11, 12 increasing dimensions for shading sun light.

A fourth and a fifth embodiment of the sunshade cap with a double layer visor are shown in FIGS. 9 and 10, which have different shapes of the upper layer visor 4, an annular shape for FIG. 9, and a very wide shape for FIG. 10, having almost the same sunshading function.

What is claimed is:

1. A sunshade cap with a double layer visor comprising an upper layer visor consisting of a front visor, a left visor, and a right visor, the front visor being sewn to the left visor to form a hinged connection therebetween, the front visor being sewn to the right visor to form a hinged connection therebetween, a fastener band sewn under the upper layer visor which fastens to a fastener band provided under a visor of a sunshade cap, a size adjustment mechanism provided between the left and the right visor, and a tie band attached to the upper layer visor for tying the upper layer visor under the chin of a user.

* * * * *